US008640302B2

(12) United States Patent
Liffers et al.

(10) Patent No.: US 8,640,302 B2
(45) Date of Patent: Feb. 4, 2014

(54) ARRANGEMENT FOR POSITIONING AND HOLDING A FILTER BAG IN A VACUUM CLEANER

(75) Inventors: Achim Liffers, Velbert (DE); Bernd Falkenstein, Wuppertal (DE)

(73) Assignee: Stein & Co. GmbH, Velbert (DE)

( * ) Notice: Subject to any disclaimer, the term of this patent is extended or adjusted under 35 U.S.C. 154(b) by 287 days.

(21) Appl. No.: 13/052,191

(22) Filed: Mar. 21, 2011

(65) Prior Publication Data

US 2011/0232025 A1 Sep. 29, 2011

(30) Foreign Application Priority Data

Mar. 23, 2010 (DE) ..... 10 2010 012 637

(51) Int. Cl.
*A47L 9/20* (2006.01)

(52) U.S. Cl.
USPC ..... 15/347; 15/327.2; 15/352

(58) Field of Classification Search
USPC ..... 15/347; 55/373
See application file for complete search history.

(56) References Cited

U.S. PATENT DOCUMENTS

2006/0064951 A1* 3/2006 Stein et al. ..... 55/373

* cited by examiner

*Primary Examiner* — Monica Carter
*Assistant Examiner* — Stephanie N Berry
(74) *Attorney, Agent, or Firm* — W. F. Fasse

(57) ABSTRACT

A filter bag of a vacuum cleaner has a filter mounting plate that includes a generally strap-shaped securing element with pivot members on an end thereof. A housing of the vacuum cleaner defines a filter bag compartment therein and has pivot receivers into which the pivot members can be substantially vertically inserted. Then the filter mounting plate can be pivoted into a substantially horizontal installed position as the filter bag is inserted into the filter bag compartment. In the installed position, a first stop member of the filter mounting plate contacts and is stopped by a second stop member of the housing so as to prevent further pivoting and so as to properly position and hold the filter mounting plate.

12 Claims, 3 Drawing Sheets

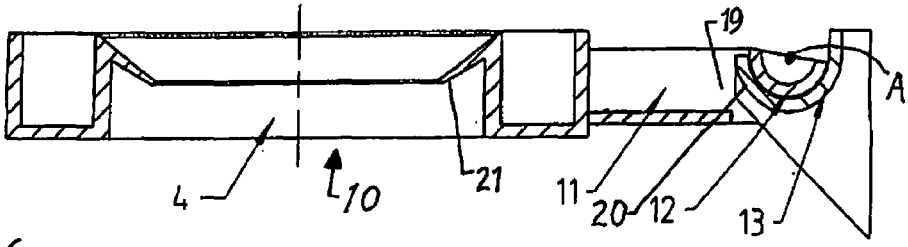
FIG. 6
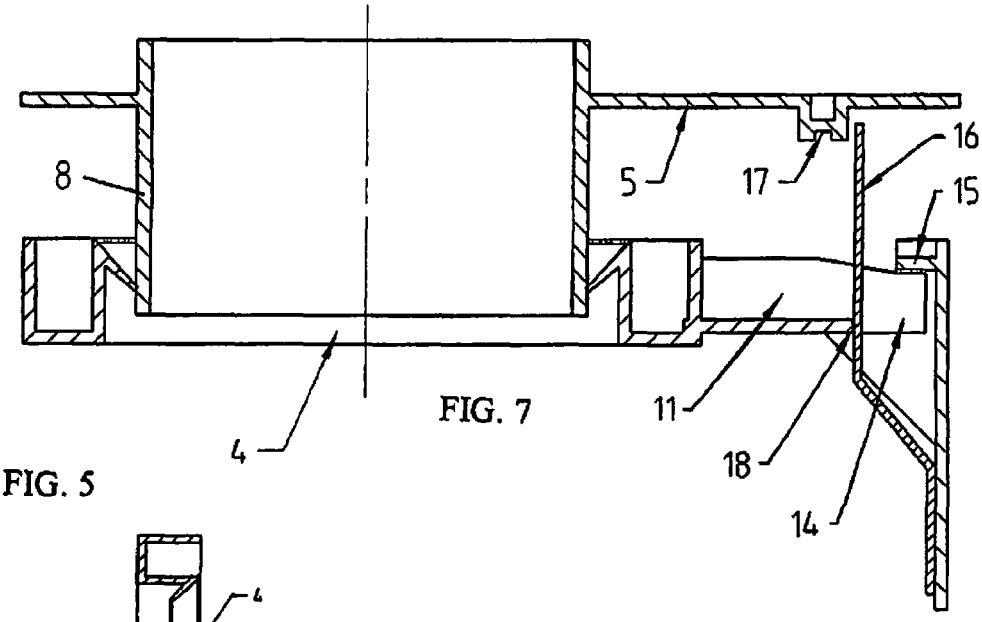
FIG. 7
FIG. 5
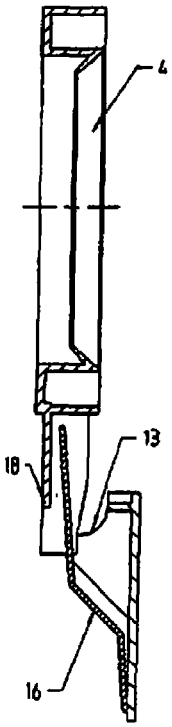
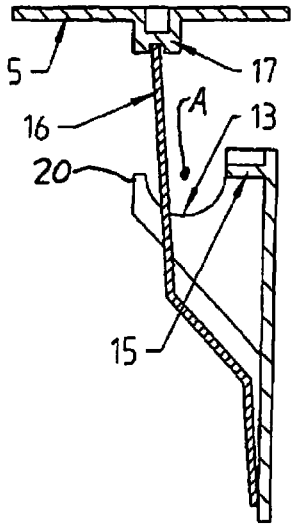
FIG. 8

ARRANGEMENT FOR POSITIONING AND HOLDING A FILTER BAG IN A VACUUM CLEANER

PRIORITY CLAIM

This application is based on and claims the priority under 35 USC §119 of German Patent Application 10 2010 012 637.3, filed on Mar. 23, 2010, the entire disclosure of which is incorporated herein by reference.

FIELD OF THE INVENTION

The invention relates to an arrangement for properly positioning and holding a filter bag in a filter bag compartment of a vacuum cleaner.

BACKGROUND INFORMATION

Vacuum cleaner configurations are known, in which a filter bag is arranged in a filter bag compartment defined in the housing of the vacuum cleaner, and a filling tube or pipe stub is provided on a movable lid that closes the filter bag compartment. When closing the lid, the filling pipe stub must accurately align with and engage into a filling hole of the filter bag. The vacuum hose is then externally plugged into the filling pipe stub to communicate the dirt-laden air into the filter bag during operation of the vacuum cleaner. Therefore, in such vacuum cleaners, it is important for the filter bag to be properly positioned and held in the filter bag compartment when the filter bag is installed and until the lid is closed so that the filling pipe stub properly engages into the filling hole.

In order to address this requirement, it is known to provide the filter bag with a stiffening element in the form of a filter mounting plate with the bag filling hole therein. The filter mounting plate is inserted in or engaged with a corresponding receiver arrangement connected to the housing of the vacuum cleaner in the filter bag compartment, to position and hold the filter bag in the bag compartment. The filling pipe stub provided on the bag compartment lid of the vacuum cleaner is inserted into the bag filling hold of the filter bag, whereby a seal is provided at the perimeter of the hole around the filling pipe stub. More particularly, it is known to provide slide channels as the receivers for the filter mounting plate, whereby the filter mounting plate slides into the slide channels to be engaged and held therein, so that the filter bag and especially the filling hole thereof is then held in the proper defined position within the bag compartment. However, such known slide channels as the receivers for the filter mounting plate require the user to carry out a relatively exact alignment and careful sliding of the filter mounting plate into the receiver channels. Any misalignment of the filter mounting plate relative to the channels, or any diagonally skewed forward sliding of the filter mounting plate results in jamming, such that the filter mounting plate is not properly positioned in the receiver channels. Also, such receiver channels are subject to accumulating dust and other debris, whereby the channels become clogged or too tight for allowing the filter mounting plate to easily slide therein. These negative aspects cause problems and difficulties for the user of the vacuum cleaner when carrying out a filter bag exchange as routine maintenance of the vacuum cleaner.

SUMMARY OF THE INVENTION

In view of the above, it is an object of the invention to provide a simplified receiver or mounting arrangement for a filter mounting plate of a filter bag in the filter housing of a vacuum cleaner. The arrangement shall be simple and economical in construction, and shall be user-friendly with regard to the use or handling thereof for installing a filter bag, and shall also be insensitive to the accumulation of dust or debris, while ensuring a proper positioning and secure support of the filter mounting plate and thus the filter bag in the vacuum cleaner. The invention further aims to avoid or overcome the disadvantages of the prior art, and to achieve additional advantages, as apparent from the present specification.

The above objects have been achieved according to the invention in a vacuum cleaner equipped with a filter bag having a filter mounting plate as a stiffening element, with a bag fill opening in the filter mounting plate. The filter mounting plate preferably comprises a generally strap-shaped securing element for positioning and securing the filter bag in the housing of the vacuum cleaner. On an end portion thereof, the strap-shaped securing element includes holding elements or pivot members that are insertable into corresponding pivot receivers on the vacuum cleaner housing in the bag compartment, whereby the pivot members allow the filter mounting plate and the filter bag to be pivoted about a pivot axis, downwardly into the bag compartment into the use position, while the pivot members pivot in the receivers. Then, a rim portion or protruding tongue of the securing element is held in this position and prevented from further pivoting rotation by a counter support or stop member such as a retaining lip or flange of the vacuum cleaner housing. More generally, the filter mounting plate includes a pivot member that is inserted into a pivot receiver of a bag holder arrangement connected to the vacuum cleaner housing in the bag compartment thereof. The pivot member can be inserted into, and is then pivotably supported by the pivot receiver, and allows the filter mounting plate and therewith the filter bag to pivot by about 90°, or at least about 60°, from a substantially vertical insertion position to a substantially horizontal use position. The terms "substantially vertical" and "substantially horizontal" mean, for example, within a range of 30° from vertical or horizontal, when the vacuum cleaner is oriented with its major dimension axis extending horizontally. When the filter mounting plate is in this use position, a first stop member of the filter mounting plate is pivoted into contact with, and thereby prevented from further pivoting by, the second stop member of the bag holder arrangement on the vacuum cleaner housing. Thereby, the filter mounting plate is held in the use position.

In a preferred embodiment, the pivot member of the filter mounting plate has a configuration of a pivot pin with a partial cylindrical convex contour, and the pivot receiver of the bag holder arrangement of the vacuum cleaner housing has a configuration of a partial cylindrical concave trough. In an alternative embodiment, these configurations can be reversed, namely the pivot member of the filter mounting plate can have a partial cylindrical recessed or concave trough configuration, which seats onto a partial cylindrical bulging or convex surface of a pivot pin member as the pivot receiver of the vacuum cleaner housing.

With the above inventive arrangement, it is ensured that exchanging the filter bag can be carried out in a simple manner without any problems or difficulties, and while avoiding the disadvantages of the prior art. Thereby, the proper positioning and holding of the filter bag is achieved exclusively by the securing element of the filter mounting plate engaging the corresponding counterpart components of the receiver arrangement or bag holder arrangement of the housing of the vacuum cleaner. Thus, other conventionally typical components for positioning or holding the filter bag properly in the bag compartment of the vacuum cleaner are no longer necessary and are thus omitted and avoided in the inventive arrangement. The components are not sensitive to accumulation of dust and debris, and remain functional without interference even after a long operating life of the vacuum cleaner. Furthermore, relatively large dimension and position tolerances of the various cooperating components are possible.

In a particular advantageous embodiment, the pivot members of the filter mounting plate are embodied and configured as approximately half-cylindrical guide elements with a convex outer contact surface, while the receivers of the bag holder arrangement of the vacuum cleaner housing are configured and embodied as corresponding approximately semi-cylindrical recessed troughs with a concave contact surface, whereby the guide elements are insertable into the trough-shaped receivers, and are then pivotable about the pivot axis with the semi-cylindrical convex contact surfaces pivotally sliding along the semi-cylindrical concave contact surfaces. At the end of the pivoting range, when the filter mounting plate is in the substantially horizontal use position, an outer edge portion of the securing element of the filter mounting plate engages under a protruding counter-support or stop member such as a retaining lip or flange of the bag holder arrangement of the vacuum cleaner housing, which prevents a further pivoting motion of the filter mounting plate.

According to further preferred features of the invention, the pivot member(s) comprise two collinearly arranged pivot guide elements that are axially spaced apart from one another along the pivot axis, while the receiver or bag holder arrangement of the vacuum cleaner housing includes two corresponding collinearly arranged pivot receivers to respectively receive the two guide elements. The outer end or edge portion of the strap-shaped securing element preferably includes two tongues or webs that are contacted and stopped by the counter-support in the form of a retaining lip or flange of the vacuum cleaner housing. To further improve the fixing of the filter mounting plate it is additionally preferred that the strap-shaped securing element has slots or slits therein adjacent to the pivot members, whereby these slots or slits are engaged on corresponding receiver fingers or prongs adjacent to the receivers of the bag holder arrangement when the filter mounting plate is pivoted into its substantially horizontal use position.

To prevent the bag compartment lid of the vacuum cleaner from being closed when no filter bag is arranged in the bag compartment, the inventive arrangement further preferably includes a pivotable or deflectable safety blocking member in the area of the receivers in the vacuum cleaner housing. The bag compartment lid includes a protruding catch element that receives and cooperates with the safety blocking member when there is no filter bag in the bag compartment and the lid is pivoted toward its closed position. Thereby, the upwardly protruding safety blocking member prevents the lid from being completely closed. On the other hand, when the filter bag is installed in the bag compartment, and particularly when the filter mounting plate is engaged in the receivers and pivoted to the use position, an edge of the securing element of the filter mounting plate presses against the safety blocking member and pivots or deflects it into a pivoted or deflected position out of engagement with the catch element of the lid. Thus, when the filter bag and the filter mounting plate are properly positioned in the bag compartment, the safety blocking member is pivoted or deflected out of its operable position and no longer blocks the closing of the bag compartment lid.

BRIEF DESCRIPTION OF THE DRAWINGS

In order that the invention may be clearly understood, it will now be described in further detail in connection with an example embodiment thereof, with reference to the accompanying drawings, wherein:

FIG. 5 is a vertical section of a filter mounting plate (without showing the filter bag) in an initial insertion position into receivers of the vacuum cleaner housing;

FIG. 6 is a vertical section of the filter mounting plate pivoted into a substantially horizontal use position, whereby the vertical section plane passes through one of the receivers in the vacuum cleaner housing;

FIG. 7 is a vertical section of the filter mounting plate pivoted into its substantially horizontal use position like in FIG. 6, but additionally showing a filling pipe stub of the bag compartment lid inserted into the fill opening of the filter mounting plate, whereby the vertical section plane passes through a pivot stop member of the vacuum cleaner housing; and FIG. 8 is a vertical section of a portion of the arrangement shown in FIGS. 6 and 7, but showing the operation of the safety blocking member that blocks the closing of the lid when no filter bag is installed in the vacuum cleaner housing.

DETAILED DESCRIPTION OF A PREFERRED EXAMPLE EMBODIMENT AND BEST MODE OF THE INVENTION

Figure 1:
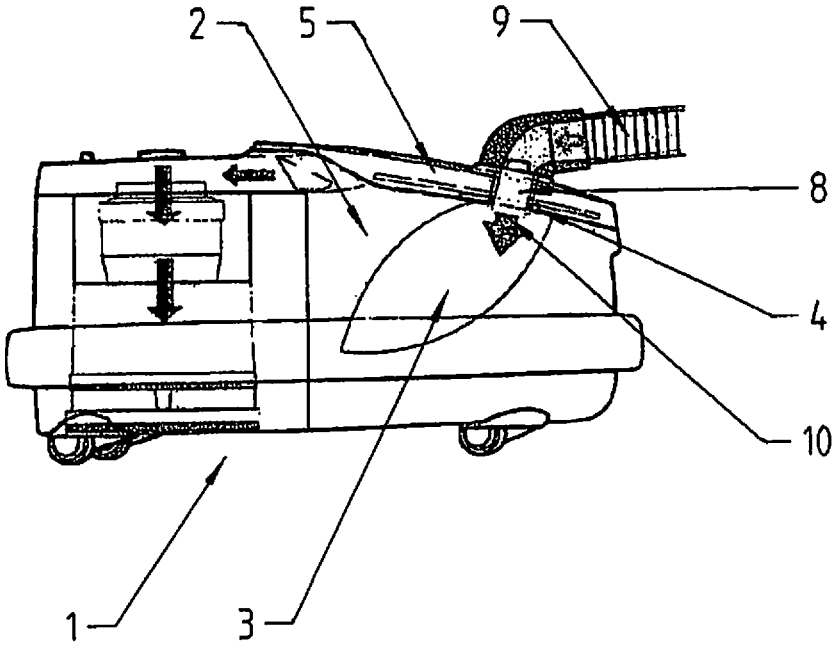
FIG. 1 is a schematic principle illustration of a vacuum cleaner with an inserted filter bag, including an arrangement according to the invention, in a side elevation ghost view.

As shown in FIG. 1, a vacuum cleaner 1 includes a housing 2 that defines a filter bag compartment therein. A filter bag 3 is inserted into the filter bag compartment. The filter bag 3 includes a bag of filter material and a filter mounting plate 4 by which the filter bag 3 is mounted, positioned and held in the filter bag compartment in the vacuum cleaner housing 2. The filter bag compartment can be selectively opened or closed by a pivotable bag compartment lid 5, which includes a filling pipe stub 8 to which a vacuum hose connector 9 can be externally connected. The filter mounting plate 4 of the filter bag 3 has a fill opening 10 and a seal 21 around the perimeter of the opening 10. When the filter mounting plate 4 is properly positioned, closing the lid 5 causes the filling stub 8 to be inserted or engaged into the fill opening 10, and the seal 21 seals around the filling stub 8.

For properly positioning and securing the filter mounting plate 4 and thus therewith the filter bag 3 in the bag compartment in the vacuum cleaner housing 2, the filter mounting plate 4 includes a plate body that is connected to the bag, and a strap-shaped or tongue-shaped securing element 11 that extends laterally from the plate body, which includes the fill opening 10 and the seal 21 around the perimeter thereof. A distal free end portion of the securing element 11 includes two pivot members or holding elements 12 that are arranged collinearly and axially spaced apart from one another along a pivot axis A. In the present embodiment, each pivot member 12 is formed as a substantially semi-cylindrical shell forming a semi-cylindrical hollow pivot pin that bulges downwardly with a convex semi-cylindrical pivoting contact surface as shown especially in FIG. 6. Corresponding trough-shaped receivers 13 are provided in a bag holder arrangement on the vacuum cleaner housing 2. Namely, as shown especially in FIG. 6, each receiver 13 has a concave semi-cylindrical trough shape that matingly receives the convex semi-cylindrical pivot pin shape of the respective allocated pivot member 12 of the filter mounting plate 4. The semi-cylindrical shapes need not be exactly half of a cylinder, but may be e.g. a portion of a cylinder spanning from 80° to 190° about the pivot axis A. But preferably, the semi-cylindrical shapes span approximately half of a cylinder, e.g. 160° to 190°. In the inserted or engaged condition, the holding element or pivot member 12 and the associated trough-shaped pivot receiver 13 are coaxial about the pivot axis A, so as to allow the pivot member 12 to smoothly pivot in the trough-shaped pivot receiver 13. It should be noted, however, that the concave and convex configurations of the two components 12 and 13 can be reversed in an alternative embodiment.

In order to install a filter bag 3 into the bag compartment in the vacuum cleaner housing 2, the bag is inserted vertically downwardly into the bag compartment, whereby the filter mounting plate 4 is initially moved vertically downwardly into engagement with the receiver components of the bag holder arrangement connected to the vacuum cleaner housing 2, in a substantially vertical initial insertion position as shown in FIG. 5. The bag holder arrangement being "connected" to the housing may be formed as one piece with the housing, or may be a separate component or assembly of components that is attached in any known manner to the vacuum cleaner housing. While the vertical section plane of FIG. 5 does not pass through one of the pivot members and thus does not show the pivot member 12 engaging into the trough-shaped pivot receiver 13, it should be understood that these components are coaxially positioned about the pivot axis A. Then, the filter mounting plate 4 is pivoted downwardly into a substantially horizontal position as shown in FIGS. 6 and 7. The above designations of horizontal and vertical assume that the vacuum cleaner 1 is oriented with its major dimension axis extending horizontally. The initial insertion position of the filter mounting plate is substantially perpendicular to the major dimension axis of the vacuum cleaner, and the final installed position of the filter mounting plate is substantially parallel to the major dimension axis of the vacuum cleaner.

The filter mounting plate 4 further includes tongues or webs 14 defining first stop members that protrude below and beyond the pivot members 12. The bag holder arrangement further includes a second stop member defined by a counter-support 15, for example in the form of a retaining lip or flange 15 of the vacuum cleaner housing 2. When the filter mounting plate 4 reaches its horizontal installed position, the first stop members or tongues 14 extend under and come into contact with the second stop member or counter-support flange 15, as shown in FIG. 7. Thereby, these tongues 14 of the filter mounting plate 4 cooperating with the counter-support flange 15 stop any further pivoting rotation of the filter mounting plate 4 beyond the substantially horizontal position shown in FIGS. 6 and 7. In this regard, the contact point of the first stop member such as the tongue 14 and the second stop member such as the counter-support flange 15 is located offset from the pivot axis A, and the members 14, 15 are fixed or rigid members so that they prevent further pivoting of the filter mounting plate 4 about the pivot axis A once the tongues 14 come into contact with the counter-support flange 15. Thus, the filter mounting plate 4 and the filter bag 3 are properly positioned and held in the bag compartment within the vacuum cleaner housing 2, and then the bag compartment lid 5 may be tilted closed in a generally known manner.

Figure 2:
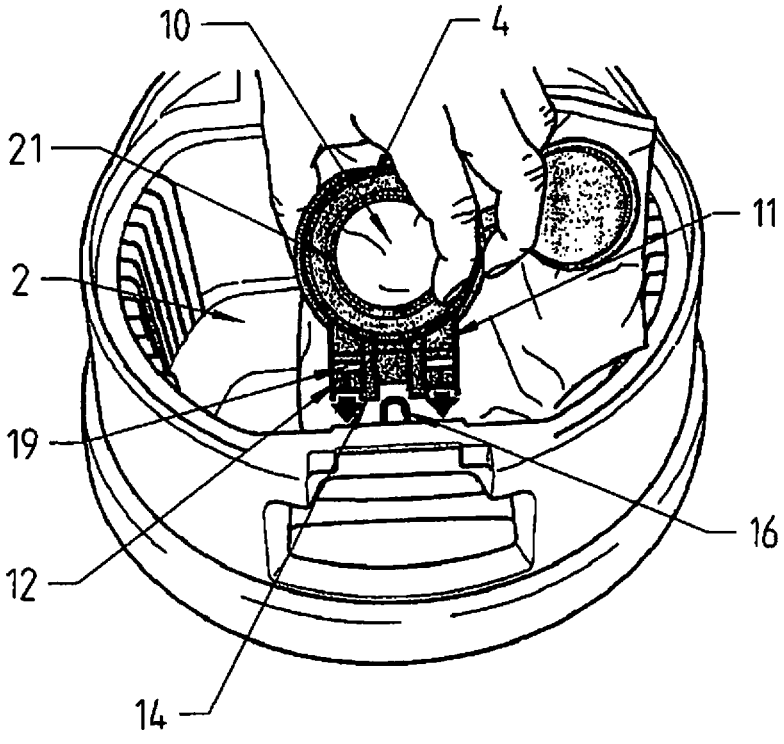
FIG. 2 is a top front perspective view of a bag compartment defined in the housing of the vacuum cleaner, with a filter bag and its filter mounting plate being inserted in the bag compartment.
Figure 3:
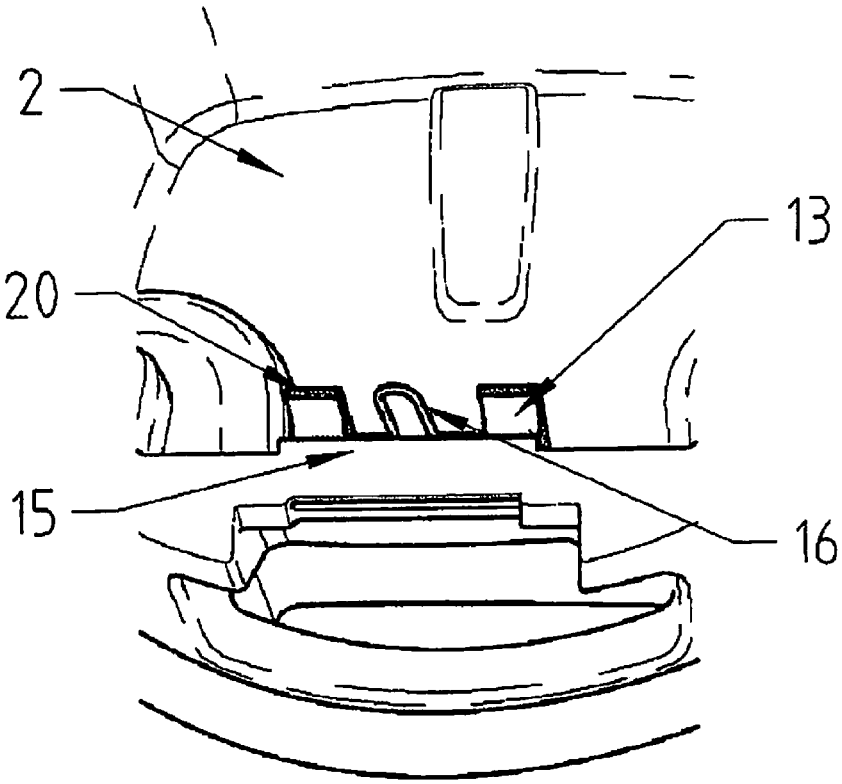
FIG. 3 is an enlarged detail view of a portion of the vacuum cleaner housing shown in FIG. 2, but without the filter bag, to better show the receivers of the vacuum cleaner housing for receiving the pivot members of the filter mounting plate.
Figure 4:
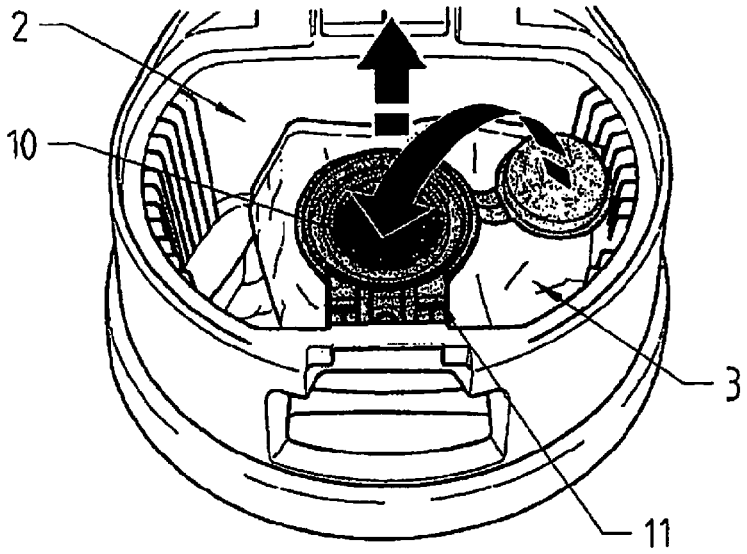
FIG. 4 is a view similar to that of FIG. 2, but showing the installed filter bag, i.e. with the filter mounting plate received and held in the receiver or bag holder arrangement of the vacuum cleaner housing.

Furthermore, to provide additional security of the positioning and holding of the filter mounting plate 4 in its installed position as shown in FIGS. 6 and 7, preferably the strap-shaped securing element 11 additionally has openings such as slits or slots 19 provided therein adjacent to the pivot members 12, as shown in FIGS. 2 and 6. When the filter mounting plate 4 is pivoted into its substantially horizontal installed position, these slots or slits 19 engage onto allocated receiver fingers or prongs 20 of the trough-shaped receivers 13, as especially shown in FIGS. 3 and 6.

It is further preferably provided that the bag compartment lid 5 may only be closed when a filter bag 3 is properly installed in the bag compartment. In order to block the closing of the lid 5 when no filter bag 3 is installed, the arrangement includes a pivotable or deflectable safety blocking member 16 as a bail that normally extends substantially vertically in an un-pivoted or un-deflected default state thereof. In this vertical position, the safety blocking member 16 aligns with and engages a protruding catch element 17 on the inner side of the bag compartment lid 5 as shown in FIG. 8. This prevents the lid 5 from being completely closed. But when a filter bag 3 with its filter mounting plate 4 is properly inserted and installed in the vacuum cleaner housing 2 as explained above, then an edge 18 of the securing element 11 presses against the safety blocking member 16 and thereby pivots or deflects the blocking member 16 out of alignment with the protruding catch element 17 of the lid 5. Thus, the blocking member 16 no longer blocks the closing movement of the lid 5, so that the lid 5 may be completely closed, whereby the blocking member 16 takes up a position next to the catch element 17 as shown in FIG. 7.

Although the invention has been described with reference to specific example embodiments, it will be appreciated that it is intended to cover all modifications and equivalents within the scope of the appended claims. It should also be understood that the present disclosure includes all possible combinations of any individual features recited in any of the appended claims. The abstract of the disclosure does not define or limit the claimed invention, but rather merely abstracts certain features disclosed in the application.

What is claimed is:

1. A vacuum cleaner comprising:

a vacuum cleaner housing defining therein a filter bag compartment;

a filter bag comprising a bag of filter material and a filter mounting plate connected thereto, wherein said filter bag is adapted to be arranged in said filter bag compartment, and wherein said filter mounting plate includes at least one pivot member and at least one first stop member; and a bag holder arrangement that is provided in said filter bag compartment and connected to said vacuum cleaner housing;

wherein said bag holder arrangement comprises at least one pivot receiver configured and arranged to receive and pivotably support said at least one pivot member to enable said filter mounting plate to pivot about a pivot axis from an initial insertion position of said filter mounting plate to a final installed position of said filter mounting plate, and at least one second stop member configured and arranged to contact and counter-support said at least one first stop member when said filter mounting plate is in said final installed position and thereby to prevent further pivoting of said filter mounting plate about said pivot axis beyond said final installed position;

wherein each one of said at least one pivot member respectively comprises a pivot pin having a convex bearing surface with an at least partial cylindrical shape about said pivot axis, each one of said at least one pivot receiver respectively comprises a pivot trough having a concave bearing surface with an at least partial cylindrical shape about said pivot axis, and said concave bearing surface matingly and pivotably receives said convex bearing surface; and wherein said filter mounting plate has a fill opening therein communicating into an interior of said bag of filter material, a fill opening axis of said fill opening extends perpendicular to a plane along which said filter mounting plate extends, and said pivot axis extends parallel to said plane and laterally offset from said fill opening axis.

2. The vacuum cleaner according to claim 1, wherein said filter mounting plate includes a plate body connected to said bag of filter material and a strap-shaped securing element protruding laterally from said plate body, said at least one pivot member and said at least one first stop member are provided at a free end of said strap-shaped securing element protruding away from said plate body, said plate body has said fill opening therein, said vacuum cleaner further comprises a lid that is movable between an open position and a closed position relative to said housing to selectively open and close said filter bag compartment, and said vacuum cleaner further comprises a filling pipe stub that is connected to and communicates through said lid and is adapted to be inserted into said fill opening when said lid is moved to said closed position.

3. The vacuum cleaner according to claim 2, wherein said filter mounting plate further includes a seal element connected to said plate body and extending around a perimeter of said fill opening.

4. The vacuum cleaner according to claim 1, wherein said initial insertion position of said filter mounting plate in which said at least one pivot member is initially inserted into said at least one pivot receiver is an orientation of said plane of said filter mounting plate substantially perpendicular to a major dimension axis of said vacuum cleaner, and said final installed position of said filter mounting plate in which said at least one first stop member contacts and is counter-supported by said at least one second stop member is an orientation of said plane of said filter mounting plate substantially parallel to said major dimension axis of said vacuum cleaner.

5. The vacuum cleaner according to claim 1, wherein said filter mounting plate includes a plate body connected to said bag of filter material and a strap-shaped securing element protruding laterally from said plate body, said at least one pivot member and said at least one first stop member are provided at a free end of said strap-shaped securing element protruding away from said plate body, said at least one first stop member respectively comprises a tongue protruding laterally at said free end of said strap-shaped securing element adjacent to said at least one pivot member, and wherein said at least one second stop member comprises an overhanging counter-support lip of said bag holder arrangement under which said tongue extends when said filter mounting plate is in said final installed position.

6. The vacuum cleaner according to claim 1, wherein said at least partial cylindrical shape of each said pivot pin and of each said pivot trough is an approximately semi-cylindrical shape.

7. The vacuum cleaner according to claim 1, wherein said at least one pivot member includes two of said pivot members arranged collinearly and spaced axially apart relative to one another along said pivot axis, and said at least one pivot receiver includes two of said pivot receivers arranged collinearly and spaced axially apart relative to one another along said pivot axis.

8. The vacuum cleaner according to claim 1, wherein said bag holder arrangement further comprises at least one receiver finger adjacent to and protruding from said at least one pivot receiver, said filter mounting plate has at least one open slot therein adjacent to said at least one pivot member, and said at least one receiver finger respectively engages into said at least one open slot when said filter mounting plate is pivoted to said final installed position thereof.

9. The vacuum cleaner according to claim 1, further comprising a pivotable or deflectable safety blocking member arranged in said filter bag compartment adjacent to said at least one pivot receiver, a lid that is movable between an open position and a closed position relative to said housing to selectively open and close said filter bag compartment, and a catch element that protrudes inwardly on an inner surface of said lid, wherein said safety blocking member in a non-pivoted non-deflected default position thereof is positioned to engage said catch element and thereby block said lid against being moved to said closed position, and when said filter mounting plate is moved to said final installed position thereof a portion of said filter mounting plate presses against said safety blocking member and pivots or deflects said safety blocking member to a non-blocking position thereof in which said safety blocking member does not engage said catch element and does not block said lid against being moved to said closed position.

10. A vacuum cleaner comprising:

a vacuum cleaner housing defining therein a filter bag compartment, a filter bag comprising a bag of filter material and a filter mounting plate connected thereto, wherein said filter bag is adapted to be arranged in said filter bag compartment, and wherein said filter mounting plate includes at least one pivot member and at least one first stop member; and a bag holder arrangement that is provided in said filter bag compartment and connected to said vacuum cleaner housing:

wherein:

said bag holder arrangement comprises at least one pivot receiver configured and arranged to receive and pivotably support said at least one pivot member to enable said filter mounting plate to pivot about a pivot axis from an initial insertion position of said filter mounting plate to a final installed position of said filter mounting plate, and at least one second stop member configured and arranged to contact and counter-support said at least one first stop member when said filter mounting plate is in said final installed position and thereby to prevent further pivoting of said filter mounting plate about said pivot axis beyond said final installed position, said filter mounting plate includes a plate body connected to said bag of filter material and a strap-shaped securing element protruding laterally from said plate body, said at least one pivot member and said at least one first stop member are provided at a free end of said strap-shaped securing element protruding away from said plate body, said at least one first stop member respectively comprises a tongue protruding laterally at said free end of said strap-shaped securing element adjacent to said at least one pivot member, said at least one second stop member comprises an overhanging counter-support lip of said bag holder arrangement under which said tongue extends when said filter mounting plate is in said final installed position, each one of said at least one pivot member respectively comprises a pivot pin having a convex bearing surface with an at least partial cylindrical shape about said pivot axis, each one of said at least one pivot receiver respectively comprises a pivot trough having a concave bearing surface with an at least partial cylindrical shape about said pivot axis, said concave bearing surface matingly and pivotably receives said convex bearing surface, wherein said plate body has a fill opening therein communicating into an interior of said bag of filter material, a fill opening axis of said fill opening extends perpendicular to a plane along which said plate body extends, and said pivot axis extends parallel to said plane and laterally offset from said fill opening axis.

11. The vacuum cleaner according to claim 10, wherein said at least one pivot member includes two of said pivot members arranged collinearly and spaced axially apart relative to one another along said pivot axis, and said at least one pivot receiver includes two of said pivot receivers arranged collinearly and spaced axially apart relative to one another along said pivot axis.

12. The vacuum cleaner according to claim 11, wherein said bag holder arrangement further comprises at least one receiver finger adjacent to and protruding from said at least one pivot receiver, said filter mounting plate has at least one open slot therein adjacent to said at least one pivot member, and said at least one receiver finger respectively engages into said at least one open slot when said filter mounting plate is pivoted to said final installed position thereof.

* * * * *